US007020908B2

(12) United States Patent
Kuru et al.

(10) Patent No.: US 7,020,908 B2
(45) **Date of Patent: *Apr. 4, 2006**

(54) TOILETS WITH QUICK FLUSH TRAPWAYS

(75) Inventors: William C. Kuru, Plymouth, WI (US); Venkata S. Krishnamurty, Sheboygan, WI (US); Daniel N. Halloran, Saukville, WI (US); Patrick Ying-Te Liu, Sheboygan, WI (US); Sudip Mukerji, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 102 days.

This patent is subject to a terminal disclaimer.

(21) Appl. No.: 10/678,362

(22) Filed: Oct. 3, 2003

(65) Prior Publication Data

US 2004/0139538 A1 Jul. 22, 2004

Related U.S. Application Data

(63) Continuation-in-part of application No. 10/347,740, filed on Jan. 20, 2003, now Pat. No. 6,944,891.

(51) Int. Cl.
*E03D 11/00* (2006.01)

(52) U.S. Cl. ..... 4/420

(58) Field of Classification Search ..... 4/420–421, 4/428

See application file for complete search history.

(56) References Cited

U.S. PATENT DOCUMENTS

| | | | | |
|---|---|---|---|---|
| 1,067,096 | A * | 7/1913 | Cochran | 4/428 |
| 2,438,507 | A | 3/1948 | Langdon | |
| 3,484,873 | A | 12/1969 | Hoard et al. | |
| 4,173,800 | A * | 11/1979 | Flegel et al. | 4/679 |
| 5,819,326 | A * | 10/1998 | Kobayashi et al. | 4/252.1 |
| 5,918,325 | A | 7/1999 | Arita et al. | |
| 5,983,413 | A | 11/1999 | Hayashi et al. | |
| 6,292,956 | B1 | 9/2001 | Kayahara | |

* cited by examiner

*Primary Examiner*—Charles E. Phillips
(74) *Attorney, Agent, or Firm*—Quarles & Brady LLP

(57) ABSTRACT

A toilet has a trapway extending between a bowl opening and an outlet opening. The trapway defines a curved, preferably uniform circular cross-section water dam region above the bowl opening, a down leg, and a straight out leg between the down leg and the outlet opening. The down leg has a rearward slope where is located a horizontal baffle. The inclined down leg and horizontal baffle work in concert to prevent the back flow of air to a region above the dam as well as to facilitate rapid entrainment and evacuation of air below the dam.

18 Claims, 6 Drawing Sheets

TOILETS WITH QUICK FLUSH TRAPWAYS

CROSS-REFERENCE TO RELATED APPLICATION

This application is a continuation-in-part of U.S. application Ser. No. 10/347,740, now U.S. Pat. No. 6,944,891, filed Jan. 20, 2003.

STATEMENT OF FEDERALLY SPONSORED RESEARCH OR DEVELOPMENT

Not applicable.

BACKGROUND OF THE INVENTION

The present invention relates to toilets provided with improved trapways.

Conventional toilets have a bowl portion and a storage tank portion, usually formed in one or two main pieces. A serpentine passage is typically positioned behind and below the bowl to transport the contents of the bowl to waste/sewer/septic plumbing lines of the building. This passage is generally referred to as the "siphon" or "trapway".

An up leg portion of such a passage is normally filled with water to "trap" sewer gases downstream thereof, so as to prevent them entering the building interior. Water is maintained in the bowl and the up leg part of the trapway by an arched portion of the trapway. The trapway (sometimes in conjunction with an adjacent jet) generates a siphon to evacuate the bowl contents when a normally air/vapor-filled downstream portion of the trapway is rapidly filled with water during the flush cycle.

The trapway thus helps retain water in the bowl prior to flushing, and then assists in the formation of a siphon helpful in removing waste during the flush cycle. Achieving these dual functions can be relatively easy where a large volume of water is used during a single flush cycle. However, for environmental and water conservation reasons many jurisdictions now restrict the sales of toilets which use too much water per flush. For example, some such regulations require no more than 1.6 gallons (6.06 liters) of water to be used per flush cycle.

Achieving an effective flush with that little water when the bowl is filled with feces, toilet paper, and other solids can be difficult. Hence, it is common with respect to some such low water usage toilets for consumers to flush the toilet twice or more to clean the bowl to their satisfaction when other than just urine is present. This not only frustrates the regulatory and conservation goals, it is time consuming for consumers.

Even where a toilet is reasonably efficient in its cleaning when using low amounts of water, there is also an interest in minimizing the time that the flush cycle takes. A short flush cycle has a number of advantages. For example, the period during which the toilet is generating maximum noise may be reduced if the flush cycle takes less time. This may be of interest if the toilet is being used during the middle of the night and the user wishes to minimize the possibility of others who are sleeping (e.g. a baby) being disturbed. Another advantage of a short flush cycle is that with such a cycle, if a second flush is needed to complete bowl cleaning, it can begin sooner.

Various attempts to accomplish a shorter flush cycle have included specially shaping the flow path, controlling the state of flow (turbulent or laminar), and/or reducing or eliminating the occurrence of air pockets at particular locations in the trapway. For example, U.S. Pat. No. 5,918,325 discloses a trapway modified in various ways to attempt to render flushing more optimal. See also U.S. Pat. Nos. 3,484,873, 5,706,529 and 6,292,956. The disclosures of these patents, and of all other patents and publications referred to herein are incorporated by reference as if fully set forth herein.

However, attempts to develop quick flush action having efficient cleaning with low volumes of water can be frustrated by "blow back", which is a tendency of such trapways to develop reverse flow of air from the plumbing lines into a low pressure region of the trapway. Accordingly, there is still a need for low volume flush toilets that have a short flush cycle, yet clean even solid bowl waste effectively and efficiently.

SUMMARY OF THE INVENTION

The invention provides a toilet having a trapway with improved water and air evacuation characteristics. In one aspect the trapway extends between a bowl opening and an outlet, the trapway having a curved water dam region extending from the bowl opening to above the bowl opening to a down leg. The down leg slopes in a rearward direction from its top to an essentially horizontal baffle extending forward from a rear wall of the down leg adjacent a lower portion of the down leg, the lower portion of the down leg being linked to an out leg communicating with the outlet.

Preferably, the dam down leg radius is between about 2.25 and 3.5 inches (, and the down leg slopes less than 15 degrees from vertical, more preferably between about 1 and 8 degrees from vertical. The baffle preferably has a ledge length of between about 0.5 and 2.5 inches measured from the rear wall of the down leg, and even more preferably between about 0.7 and 1.5. The baffle has a ledge height of between about 1.5 and 3.0 inches measured from a bottom of the out leg, and more preferably between about 1.75 and 2.5 inches.

In another preferred form, the trapway has a circular cross-section throughout the curved water dam region. The curved water dam region preferably includes a dam down leg radius adjacent the down leg between about 1.5 and 4.0 inches.

In other preferred forms at least a portion of the out leg is straight and preferably horizontal, and at least a portion of the down leg is straight. In still other preferred forms the up leg has a circular cross-section, or it has a flat interior wall. In yet another preferred form the out leg has a circular cross-section or a flat interior wall.

It is most preferred that the trapway have a minimum ball passage of about 2 inches.

In another form the toilet also has a jet providing a capability for a flow rate of between 22 and 28 (preferably about 25) gallons per minute.

The present invention thus provides a toilet with a unique trapway design. It is designed so that water from the bowl completely and quickly fills key portions of the trapway during a flush cycle. This leads to rapid evacuation of the bowl contents, minimizing water waste. The trapway design improves the full flush cycle time and significantly improves the rate of the flushing action to nearly half that of common gravity driven toilets with conventional trapway designs.

The rearwardly slightly canted down leg reduces the formation of air pockets in the water dam region which would otherwise interfere with the siphoning effect of the trapway. The baffle ledge breaks up the water passing from the down leg to entrain air and particles, and further promote their rapid evacuation through the trapway. The uniform circular cross-section of the curved water dam region helps to lift the surface of the fluid at the water dam during siphon initiation, which further helps to remove air.

These and still other advantages of the invention will be apparent from the detailed description and drawings. What follows is merely a description of preferred embodiments of the present invention. To assess the full scope of the invention the claims should be looked to as the preferred embodiments are not intended to be the only embodiments within the scope of the claims.

DETAILED DESCRIPTION OF THE PREFERRED EMBODIMENTS

Figure 1:
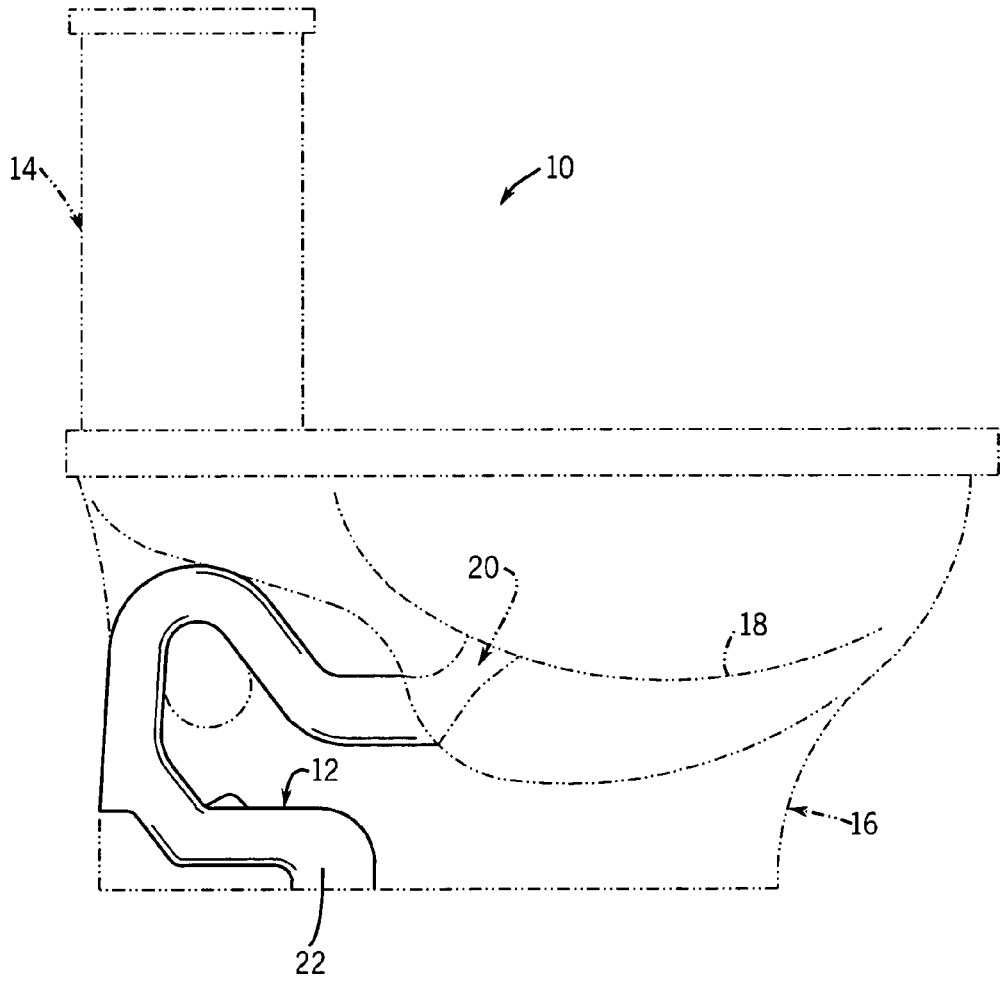
FIG. 1 is a left side elevational view of a toilet trapway according to the present invention, with a typical environment that the trapway can used in being shown in dotted lines.

FIG. 1 illustrates a toilet 10 having a siphon passage or trapway 12 design according to the present invention. In particular, other than the trapway 12, the toilet 10 can be any suitable toilet, preferably of a low volume flush design.

For example, FIG. 1 shows in hidden lines a two-piece type toilet having a separate flush tank 14 mounted to a bowl base 16. A hole (not shown) in the bottom of the flush tank 14 aligns with a hole (not shown) in the top of the bowl base 16 to allow water to pass from the flush tank and into the a bowl 18, formed in the bowl base 16, during a flush cycle.

Figure 3:
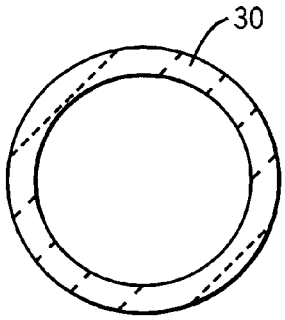
FIG. 3 is a cross-sectional view taken along line 3—3 of FIG. 2.

The trapway 12 extends from an opening 20 in the bowl 18 along a serpentine path, having for much of its length an essentially uniform and constant circular cross-section (as shown in FIG. 3). This cross-section is present at least in the second bend 30 at the dam 34.

The trapway has an outlet opening 22 at the bottom of the base of bowl 16, which mounts over the open end of a waste plumbing line (not shown). The trapway 12 thus creates a path for contents in the bowl 18 to flow to the waste/sewer/septic line during a flush cycle.

Figure 2:
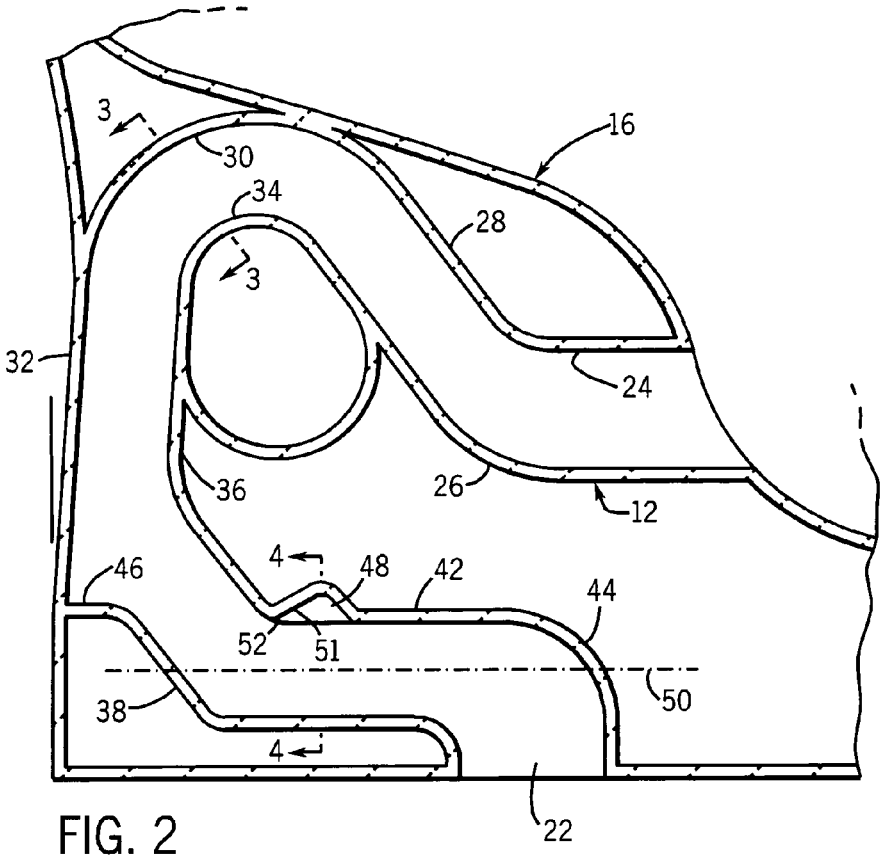
FIG. 2 is a vertical cross-sectional view taken down the front-to-back center line of the rear portion of the toilet of FIG. 1.

Referring to FIG. 2, an entry 24 of the trapway 12 extends back from the bowl opening 20 to a first bend 26. An essentially straight backwardly directed up leg 28 extends from the first bend 26 at about a 40–60 degree angle to the second bend 30. A down leg 32 extends from the second bend 30 declining slightly backwardly from top to bottom away from the opening 20 at, preferably, an angle approximately between 1–10 degrees from vertical, most preferably a 4–6 degree angle.

The bend 30 forms about a 40 degree angle between the up leg 28 and the down leg 32 so as to change flow direction about 140 degrees from the direction of flow through the up leg 28. The surface at the inside diameter of the second bend 30 forms water dam 34 (along the lower inside surface), after which point water can pass through the downstream portion of the trapway 12.

The bottom end of the down leg 32 transitions at another bend 36 which leads to a short, straight forwardly declining leg 38. Leg 38 terminates at a bend leading to a straight, horizontal out leg 42 ending at a 90 degree bend 44 leading to the outlet opening 22.

The trapway 12 has a generally uniform circular cross-section between the bowl opening and throughout the curved second bend 30 at the water dam 34 and through the down leg 32. Preferably, the inside cross-section does not vary more than 5 percent in diameter throughout this portion of the trapway 12. FIGS. 6–9 illustrate the non-circular cross-sections of the short angled leg 38 and the out leg 42, which have flat lower surfaces, primarily for casting considerations.

Adjacent the bottom end of down leg 32, the trapway 12 has a short, flat horizontal baffle 46 extending between the rear wall of the down leg 32 and the short angled leg 38. The baffle 46 preferably extends a length about equal to the radius of the down leg 32, or in one case about 1 1/16 inches. The baffle 46 works to generate turbulence and change the trajectory of the flow leaving the down leg 32, which helps move the flow downstream.

Figure 4:
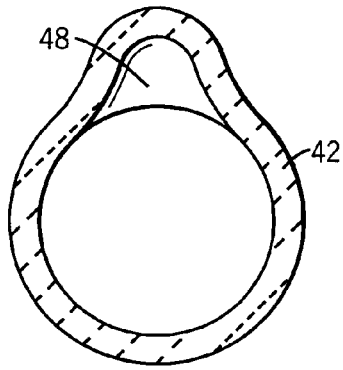
FIG. 4 is a cross-sectional view taken along line 4—4 of FIG. 2.
Figure 5:
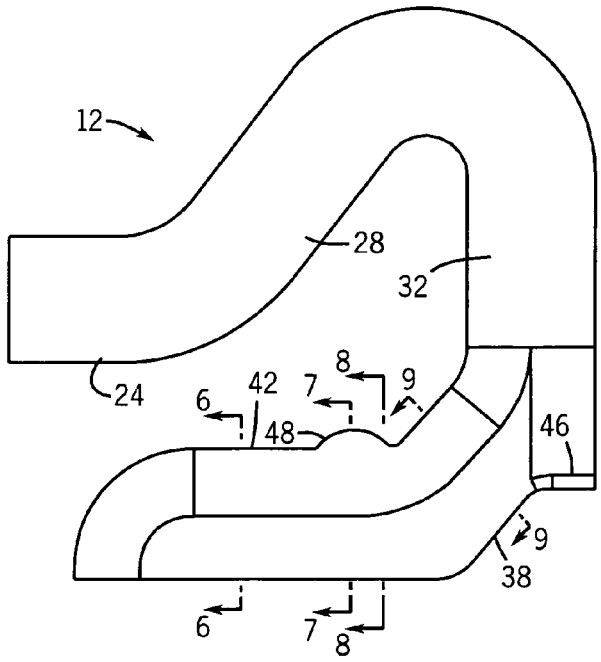
FIG. 5 is a reverse side view showing half of the trapway diagrammatically.
Figure 6:
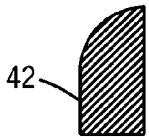
FIG. 6 is a cross-sectional view taken along line 6—6 of FIG. 5.

A recessed cavity or pocket 48, referred to herein as an air dam 48, is optionally formed to extend about an upper interior portion of the out leg 42 on a side of a centerline 50 opposite the outlet opening 22. Preferably, the air dam 48 is adjacent to the intersection of the angled leg 38 and the out leg 42. The air dam 48 extends upwardly from an upper interior surface of the out leg 42 preferably in a smooth, contoured pyramidal-type configuration such that its base is larger than its tip, as shown in FIG. 4.

Note, however, that the air dam 48 could be any suitable shape, such as hemi-spherical, as long as a sharp or small radius edge is formed at the leading edge of the air dam 48 sufficient to cause separation of the flow from the trapway 12. Preferably, the upstream upwardly extending surface 51 of the air dam 48 forms about a 90 degree angle or less to aid in separation of the fluid from the surface of the trapway 12 as described below.

Figure 7:
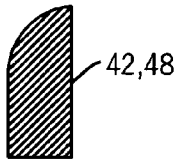
FIG. 7 is a cross-sectional view similar to FIG. 6, albeit taken along line 7—7 of FIG. 5.
Figure 8:
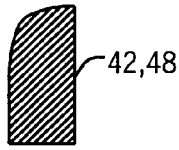
FIG. 8 is a cross-sectional view similar to FIG. 6, albeit taken along line 8—8 of FIG. 5.
Figure 9:
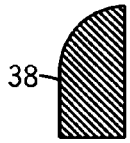
FIG. 9 is a cross-sectional view similar to FIG. 6, albeit taken along line 9—9 of FIG. 5.

FIGS. 7 and 8 show half cross-sections of the through the out leg 42 at the air dam 48. The air dam 48 can be about ½ to 1 inch (preferably ⅝") high, about ½ to 3 inches in length (preferably 1½") and about the diameter of the out leg 42 (preferably 2⅛").

The trapway 12 is designed so that water from the bowl completely and quickly fills key portions of the trapway 12 during a flush cycle. This is achieved because the backwardly canted down leg 32 reduces or eliminates the formation of air pockets at the water dam 34 which interfere with the siphoning effect of the trapway 12, the uniform circular cross-section of the second bend 30 helps to lift the surface of the fluid at the water dam 34 during siphon initiation.

Figure 10:
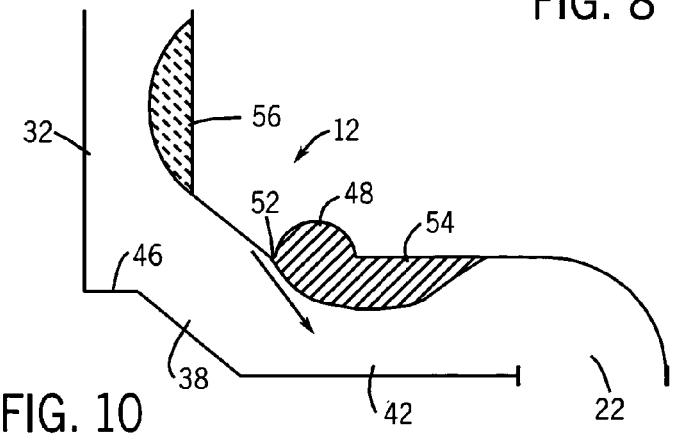
FIG. 10 is a diagrammatic representation of the trapway showing an air pocket (in full cross-hatch) generated by an air dam in an out leg of the trapway and also an air pocket (in phantom) formed by waste line blow back to a low pressure area in a down leg of the trapway not present in the trapway disclosed herein but which did occur in some prior trapway designs.
Figure 11:
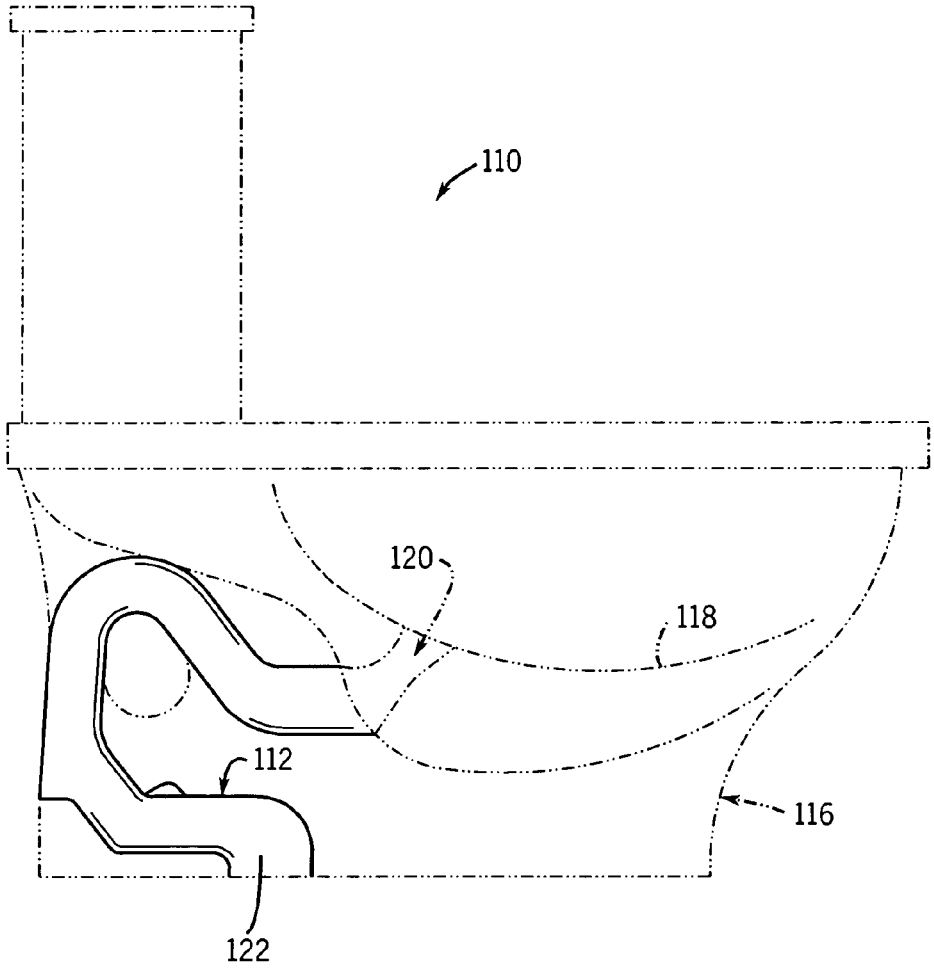
FIG. 11 is a view similar to FIG. 1, but of a second embodiment.

Furthermore, the air dam 48 aids in rapid flushing by separating the fluid from the inside wall of the down leg 32 causing a sheet of fluid within the trapway 12 that tends to block air that may try to pass back through the trapway 12 from the waste line to a low-pressure region in the down leg 42 downstream from the water dam 34. More specifically, as shown in FIG. 10, during flushing fluid passes beyond the water dam 34 into the down leg 32 and the other normally air-filled downstream portions of the trapway.

Fluid leaves the lower end of the down leg and into the short angled leg 38. After leaving the lower end of the short angled leg 38, fluid at the upper surface (when viewed as shown in FIG. 2) of the trapway passes by a leading edge surface 52 of the air dam 48 (preferably being a small radius convex surface or a short flat sharp angle surface) which leads to the upwardly extending surface 51 of the air dam 48 preferably forming a right or acute angle with the short angled leg 38. This causes the fluid to separate from the upper surface of the trapway at a relatively high velocity. This in turn causes an air pocket 54 to form generally in the region of the out leg 42 shown by the solid cross-hatching.

This effectively reduces the cross-sectional area through the out leg 42, which increases the pressure and velocity of the fluid through the out leg 42. This does two things. It increases the rate that the fluid passes through the out leg 42 (despite the smaller cross-sectional area) and causes the fluid to generate a greater down-ward force to counter the force of air in the waste line tending to move to a low pressure region in the down leg 32 and forming an air pocket 56 in the down leg 32 as represented by the hidden line cross-hatching, which is may occur sporadically depending on which pressure prevails. This phenomenon, referred to as "blow back", is adverse to providing a rapid, powerful flush. Thus, the air dam 48 helps prevent blow back, and thus allows the fluid to pass through the full area of the down leg 32 and short angled leg 38, and speeds the rate of flow through the out leg 42.

FIGS. 11–14 illustrate another preferred embodiment of the invention, with features analogous to the aforementioned embodiment being referenced using like reference numbers albeit preceded by the numeral "1". The trapway of this embodiment is of essentially the same construction as the aforementioned embodiment, however, without the air dam feature at the out leg.

Figure 13:
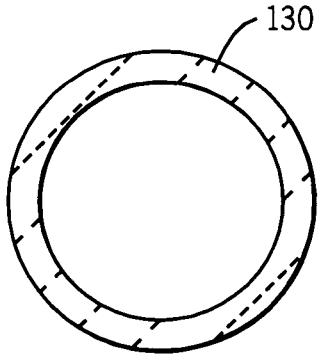
FIG. 13 is a cross-sectional view taken along line 13—13 of FIG. 12.

In particular, like above in this embodiment the toilet 110 has a siphon passage or trapway 112 extending from an opening 120 in the bowl 118 along a serpentine path, having an essentially uniform, cross-section, such as the circular cross-section (as shown in FIG. 13) at the water dam 134. The outlet opening 122 opening at the bottom of the bowl base 116 mounts over the open end of a waste plumbing line (not shown) so that the trapway 112 creates a path for contents in the bowl 118 to flow to the waste line during a flush cycle.

Figure 12:
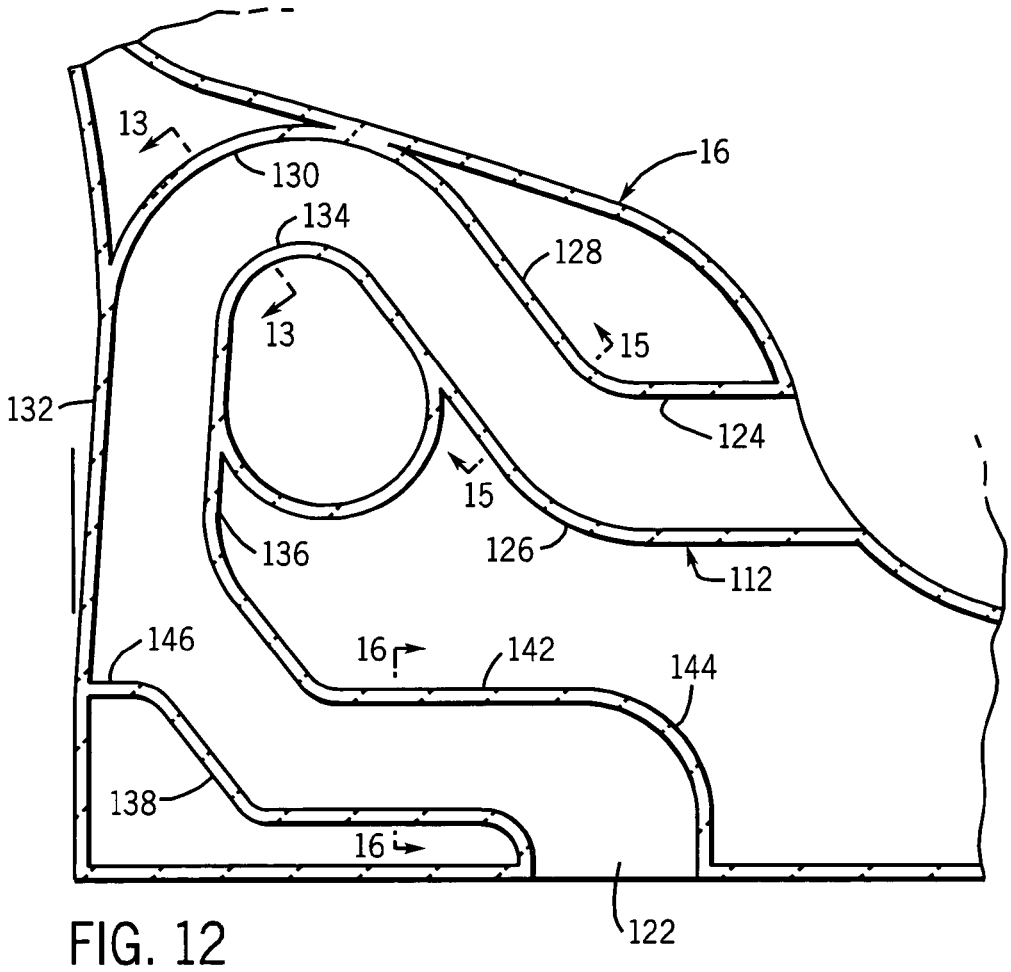
FIG. 12 is a view similar to FIG. 2, but of the second embodiment.
Figure 15A:
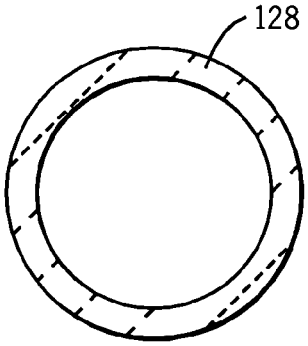
FIGS. 15A and 15B are cross-sectional views showing alternate versions of an up leg of the trapway taken along line 15—15 of FIG. 12.
Figure 15B:
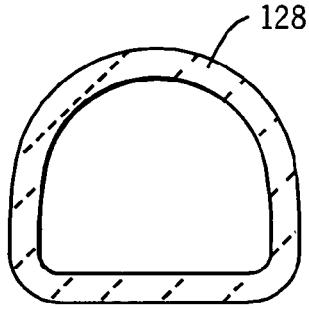

Referring now to FIG. 12, a straight entry 124 of the trapway 112 extends back from the bowl opening to a first upward bend 126. An essentially straight up leg 128, having an essentially uniform circular (as shown in FIG. 15A) or flattened circular (as shown in FIG. 15B) cross-section, extends upwardly from the first bend 126 at about a 40–60 degree angle to a second bend 130. A down leg 132 extends from the second bend 130 declining slightly backwardly from top to bottom away from the bowl opening.

The second bend 130 forms about a 40 degree angle between the up leg 128 and the down leg 132. The surface at the inside diameter of the second bend 130 forms the water dam 134 (along the lower inside surface) after which point water can pass from the bowl to the waste line through the downstream portion of the trapway 112. The bottom end of the down leg 132 transitions at another bend 136 which leads to a short, straight forwardly declining leg 138. Leg 138 terminates at a bend 140 leading to a straight, horizontal out leg 142 ending at a 90 degree bend 144 leading to the outlet opening 122.

Figure 16:
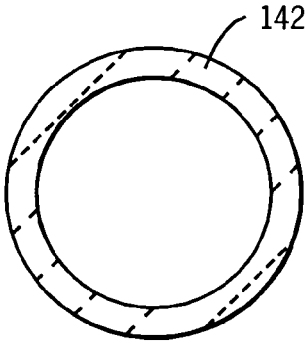
FIGS. 16A and 16B are cross-sectional views showing alternate versions of an out leg of the trapway taken along line 16—16 of FIG. 12.
Figure 16B:
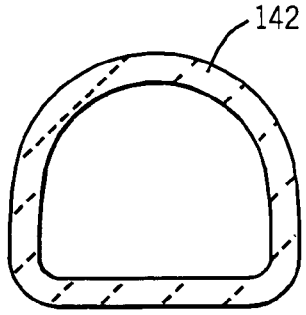

The trapway 112 can have a generally uniform circular cross-sections including between the bowl openings throughout the curved second bend 130 at the water dam 134 and through the down leg 132 (see FIGS. 13, 15A and 16A). In this case, preferably, the inside cross-section does not vary more than 5 percent in diameter throughout this portion of the trapway 112. The up leg 128 and out leg 142 sections of the trapway 112 could, alternatively, have flattened lower surfaces, essentially forming a linear chord surface intersecting the inner diameter of these legs (see FIGS. 15B and 16B). This flattened configuration of the up leg 128 and the out leg 142 is similar to the non-circular cross-sections of the short angled leg 38 and the out leg 42 of the aforementioned embodiment shown in FIGS. 6 and 9, which have flat lower surfaces primarily for casting considerations.

Adjacent the bottom end of down leg 132, the trapway 112 has a short, flat horizontal baffle 146 extending between the rear wall of the down leg 132 and the short angled leg 138. The baffle 146 works to generate turbulence and change the trajectory of the flow leaving the down leg 132, which helps move the flow downstream.

The trapway 112 is designed so that water from the bowl completely and quickly fills key portions of the trapway 112 during a flush cycle. This is achieved because the backwardly canted down leg 132 reduces or eliminates the formation of air pockets at the water dam 134 which interfere with the siphoning effect of the trapway 112, the uniform circular cross-section of the second bend 130 also helps to lift the surface of the fluid at the water dam 134 during siphon initiation.

Fluid passes beyond the water dam 134 into the down leg 132 and the other normally air-filled downstream portions of the trapway. Fluid leaves the lower end of the down leg 128 and is interrupted by the baffle 146 before entering the short angled leg 138. This disruption causes turbulent flow through the out leg 142 which works to entrain air in this region and thereby increase the rate that the fluid passes through the out leg 142 to counter air blow back.

Figure 14:
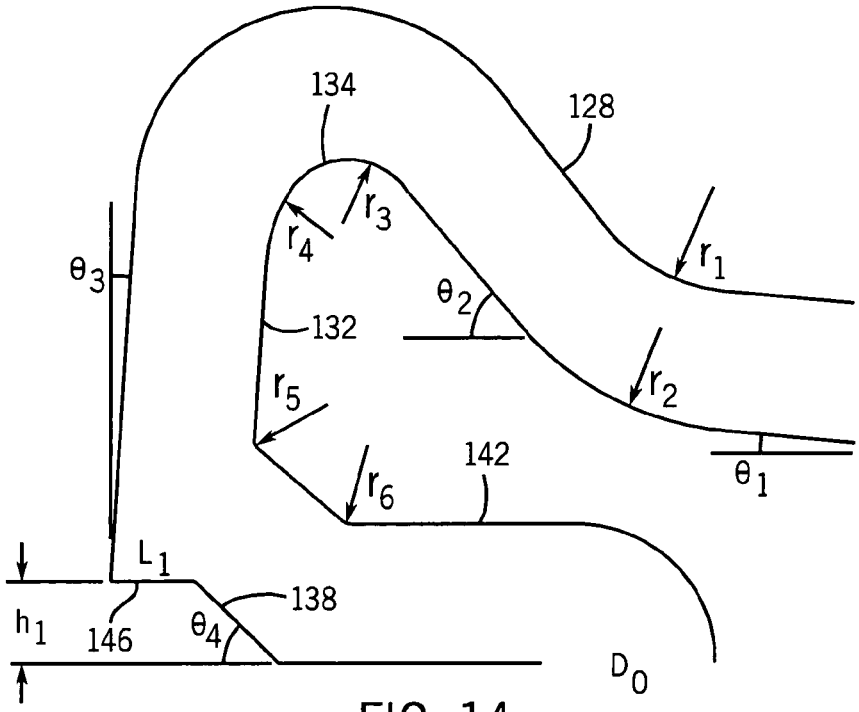
FIG. 14 is a diagrammatic representation of the trapway of FIG. 11, with identification of certain parameters of the trapway.

With reference to FIG. 14, the trapway 112 is configured with several design parameters intended to achieve rapid flushing action. Several of this parameters were discussed above, however, the following table summarizes eleven of the most significant parameters. Where appropriate, a range of preferred values is provided for each parameter.

TABLE 1

Trapway design parameters.

| Parameter | Range |
|---|---|
| Trapway up leg radius ($r_1$) | 2.0–4.0 inches |
| Trapway up leg angle ($\theta_2$) | 45–60 degrees |
| Up leg shape | Round or flat |
| Trapway dam up leg radius ($r_3$) | 1.0–3.0 inches |
| Trapway dam down leg radius ($r_4$) | 1.5–4.0 |
| Trapway dam down leg angle ($\theta_3$) | 0–15 degrees |
| Trapway corner radius ($r_5$) | 1–5 inches |
| Baffle ledge length ($L_1$) | 0.5–2.5 inches |
| Baffle ledge height ($h_1$) | 1.5–3.0 inches |
| Out leg shape | Round or flat |
| Outlet diameter ($D_o$) | 2.0–3.0 inches |

The ranges provided above are selected for a trapway with a ball passage of about 1.8 to 2.1 inches and a toilet with jet way, as understood in the art, providing an initial flow rate of approximately 25 gallons per minute ("gpm") and a "hold down" flow rate, in which the water level in the bowl is at or below the bowl opening, of approximately 10 gpm.

Of the eleven parameters noted above, the inventors of the present invention have determined empirically that the three parameters most critical to rapid flushing are the trapway to dam down leg radius ($r_4$), down leg angle ($\theta_3$), and the baffle ledge length ($L_1$).

The down leg 132 is designed to extend from the second bend 130 backwardly from top to bottom away from the bowl opening at, preferably, an angle approximately between 1–15 degrees from vertical, more preferably between about 1–8 degrees, and most preferably between about 4–6 degrees from vertical. The down leg trap radius ($r_4$) is preferably 1.5–4.0, and more preferably 2.25–3.5 inches. This radius is selected to help develop the liquid flow profile over the water dam to ensure water flows closely around the inner bend of the water dam and push downstream air in this region toward the outlet.

The baffle 146 preferably extends a length of about 0.5–2.5 inches and more preferably about 0.7–1.5 inches for more optimal interruption of the water flow without closing off the passageway excessively. Further, the baffle 146 is preferably disposed at a height of about 1.5–3.0 inches from the lower surface of the out leg, and more preferably at about 1.75–2.5 inches. As mentioned, these valves are selected for a ball passage of about 2 inches. The baffle ledge height and length will vary up or down proportionally to the radius of the down leg.

It should be appreciated that preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The invention provides improved toilets that more efficiently flush waste material by assisting downstream flow of air in the trapway and by resisting upstream air blow back into the trapway.

What is claimed is:

1. In a toilet of the type having a trapway, the trapway extending between a bowl opening and an outlet, the trapway having a curved water dam region extending from the bowl opening to above the bowl opening to a down leg, the improvement comprising:

the down leg slopes in essentially uniform cross-section in a rearward direction from the water dam region to an essentially horizontal baffle extending forward from a rear wall of the down leg adjacent a lower portion of the down leg, the lower portion of the down leg being linked to an out leg communicating with the outlet.

2. The toilet of claim 1, wherein the trapway has a circular cross-section throughout the curved water dam region.

3. The toilet of claim 1, wherein the curved water dam region includes a dam down leg radius adjacent the down leg between about 1.5 and 4.0 inches.

4. The toilet of claim 3, wherein the dam down leg radius is between about 2.25 and 3.5 inches.

5. The toilet of claim 1, wherein the out leg is essentially horizontal.

6. The toilet of claim 5, wherein at least a portion of the out leg is straight.

7. The toilet of claim 1, wherein at least a portion of the down leg is straight.

8. The toilet of claim 1, wherein the down leg slopes less than 15 degrees from vertical.

9. The toilet of claim 8, wherein the down leg slopes between about 1 and 8 degrees from vertical.

10. The toilet of claim 1, wherein the trapway has a minimum ball passage of about 2 inches.

11. The toilet of claim 1, wherein the up leg has a circular cross-section.

12. The toilet of claim 1, wherein the up leg has a flat interior wall.

13. The toilet of claim 1, wherein the out leg has a circular cross-section.

14. The toilet of claim 1, wherein the out leg has a flat interior wall.

15. In a toilet of the type having a trapway, the trapway extending between a bowl opening and an outlet, the trapway having a curved water dam region extending from the bowl opening to above the bowl opening to a down leg, the improvement comprising:

the down leg slopes in a rearward direction from its top to an essentially horizontal baffle extending forward from a rear wall of the down leg adjacent a lower portion of the down leg, the lower portion of the down leg being linked to an out leg communicating with the outlet;

wherein the baffle has a ledge length of between about 0.5 and 2.5 inches measured from the rear wall of the down leg.

16. The toilet of claim 15, wherein the ledge length is between about 0.7 and 1.5.

17. In a toilet of the type having a trapway, the trapway extending between a bowl opening and an outlet, the trapway having a curved water dam region extending from the bowl opening to above the bowl opening to a down leg, the improvement comprising:

the down leg slopes in a rearward direction from its top to an essentially horizontal baffle extending forward from a rear wall of the down leg adjacent a lower portion of the down leg, the lower portion of the down leg being linked to an out leg communicating with the outlet;

wherein the baffle has a ledge height of between about 1.5 and 3.0 inches measured from a bottom of the out leg.

18. The toilet of claim 9, wherein the ledge height is between about 1.75 and 2.5 inches.

* * * * *